US009273463B1

(12) United States Patent
Kossman

(10) Patent No.: US 9,273,463 B1
(45) Date of Patent: Mar. 1, 2016

(54) CURTAIN WALL BUILDING ENVIRONMENTAL CONTROL SYSTEMS AND METHODS

(71) Applicant: Curtis Kossman, Pittsburgh, PA (US)

(72) Inventor: Curtis Kossman, Pittsburgh, PA (US)

( * ) Notice: Subject to any disclaimer, the term of this patent is extended or adjusted under 35 U.S.C. 154(b) by 0 days.

(21) Appl. No.: 14/667,400

(22) Filed: Mar. 24, 2015

(51) Int. Cl.
*E04B 2/90* (2006.01)
*E04B 1/70* (2006.01)

(52) U.S. Cl.
CPC ..... *E04B 2/90* (2013.01); *E04B 1/7015* (2013.01)

(58) Field of Classification Search
CPC ..... E04B 2/88; E04B 2/90; E04B 5/48; E04B 1/7069; E04B 1/7076
USPC ..... 52/235, 220.1, 220.7, 220.8, 302.1, 52/302.2, 302.3, 302.7, 745.05
See application file for complete search history.

(56) References Cited

U.S. PATENT DOCUMENTS 2,462,557 A 2/1949 Santee
2,649,726 A * 8/1953 Wyman ..... F24F 7/00 237/50
3,500,596 A 3/1970 Andersson
4,296,798 A * 10/1981 Schramm ..... E04B 1/74 126/629
4,518,033 A 5/1985 Gartner
4,580,487 A * 4/1986 Sosnowski ..... F24F 5/0075 126/400
6,754,997 B2 * 6/2004 Bonin ..... E04C 2/521 52/198
8,191,325 B2 6/2012 Ting
8,276,337 B2 10/2012 Plini
8,591,206 B2 * 11/2013 Krenik ..... F25B 9/004 310/309
8,733,032 B2 5/2014 Liu
2008/0086981 A1 4/2008 Kilkis et al.
2013/0040551 A1 2/2013 Serras
2013/0168041 A1 7/2013 Teron

FOREIGN PATENT DOCUMENTS

WO 2011018088 A2 2/2011

* cited by examiner

*Primary Examiner* — Brian Glessner
*Assistant Examiner* — Adam Barlow
(74) *Attorney, Agent, or Firm* — Thomas Lizzi; IP & Internet Law North, LLC

(57) ABSTRACT

Building environmental control systems are disclosed which comprise one or more prefabricated temperature sensing and control panels in operable communication with a system control unit, an air handling system, and a heating and/or cooling utility supply system. The panels are configured to constitute a portion of the sheathing of a building or an internal partition. According to some embodiments, the panels include an outer wall and an inner wall defining an inner space therebetween in which is situated a heat exchanger and a temperature sensor. Each panel comprises an inlet to admit an air stream into its inner space and an outlet for discharging the air stream into a space adjacent to the inner wall after having been thermally conditioned by the heat exchanger.

20 Claims, 7 Drawing Sheets

CURTAIN WALL BUILDING ENVIRONMENTAL CONTROL SYSTEMS AND METHODS

BACKGROUND

1. Field of the Invention

The present invention relates to building environmental control systems and methods for controlling the environment within buildings. More specifically, the present invention relates to building environmental systems and methods which incorporate active elements of the environmental control system into curtain wall panels.

2. Background of the Invention

In modern building design, it is common to provide interior environmental control for a portion of or an entire building by way of a heating, ventilation, and air conditioning system ("HVAC system"). Conventional HVAC systems focus on dynamically controlling the ambient room temperature and humidity components of occupant comfort whereas static structural elements, e.g. wall insulation and reflective shielding, are relied upon to address the sensible radiant component of occupant comfort. While this schema works reasonably well for interior rooms, exterior rooms suffer most from its drawbacks. In exterior rooms, the mean radiant temperature experienced by an occupant changes with the occupant's proximity to the room's exterior walls and windows. Because of this, the exterior rooms in the sunny sides of a building are often sensed by their occupants as being too hot whereas the exterior rooms in the shady sides of a building are often sensed by their occupants as being too cool. Local thermostatic controls and zoning systems of HVAC systems diminish this problem to some extent by controlling the temperature and humidity of the conditioned air in the occupied spaces but they do little to address the underlying cause of the problem—the exchange of heat between the building's outer surface and the outdoors and its resulting effects on the radiant heat exchange between the exterior rooms' outer walls and the individuals within the exterior rooms.

SUMMARY OF THE INVENTION

The present invention addresses these problems with conventional building environmental control systems and methods by providing novel environmental control systems and methods which have the capability of dynamically controlling the sensible radiant component of occupant comfort. To accomplish this, the inventive systems and methods include or utilize novel building panels which are capable of dynamic temperature control and which may be adapted to form a portion of a building's façade. The panels may be adapted for use with conventional unitized curtain wall systems.

In one aspect of the present invention, embodiments are building environment control systems comprising one or more prefabricated temperature sensing and control panels in operable communication with a system control unit, an air handling system, and a heating and/or cooling utility supply system. Each such panel is a single unit of the overall environmental control system. Each such panel typically, though not always, is approximately one story tall and is configured to be hung from, or otherwise attached to, a building's frame to form the building's outer skin or sheath. The width of each such panel may be approximately one window width, although some such panels may have multiple windows across their widths and not all panels have windows. Each such panel contains an outer, i.e. weather-side, wall and an inner, i.e. interior side, wall separated by an inner space of less than about 18 inches (about 0.7 meters) wide. The inner space is configured to permit top-to-bottom or bottom-to-top or side-to-side air flow. For such panels which have windows, the outer and inner walls preferably have corresponding windows and the inner space preferably have grates positioned at the top and bottom and/or at the sides of the windows for blocking view into the inner space around the windows without substantially obstructing the vertically or horizontally directed air flow within the inner space. Opaque or spandrel portions of the outer wall preferably are thermally insulated on their inner side.

Many, although not all, such panels have within their inner space a heat exchanger which can be used for heating and/or cooling the vertically or horizontally flowing air. Connectors from the heat exchanger preferably pass through the top or bottom of the inner wall of each panel to connect to a heating/cooling supply system. Panels having top connectors are adapted for use with drop ceilings and panels having bottom connectors are adapted for use with raised floors. Such panels include within their inner space one or more temperature sensors which communicate with the system's environmental system control unit which controls the heat exchanger within the corresponding panel in accordance with the input it receives from the panel's temperature sensor or temperature sensors to optimize the panel's inner space temperature and thereby the panel's inner and outer wall temperatures. For example, on a sunny winter day, the environmental system control unit may command panel heat exchangers to cool panels receiving direct sunlight and to heat panels which are in shadow. Each such panel preferably includes one or more vents for dispersing the heat exchanger-conditioned air from the inner space into the adjacent room.

Some embodiments of this aspect of the invention also include panels which, though having inner and outer walls separated by an inner space and being adapted to permit vertical or horizontal air flow through the inner space, do not have at least one of the heat exchanger and the sensor.

In another aspect of the present invention, embodiments are various configurations of the aforesaid panels wherein the panels are adapted to be hung from, or otherwise attached to a building's frame, either to form all or a portion of the outer skin of the building or to form all or a portion of an internal partition within the building.

In another aspect of the present invention, embodiments are buildings which comprise, at least in part, the aforesaid building environmental control system and a frame adapted to receive and support the panels of the system. Such buildings may be adapted for any type of use, e.g., commercial office space, residential, manufacturing, etc., and be of any desired size, e.g. a single family dwelling, a skyscraper, etc. Some embodiments of this aspect of the invention include interior partitions which comprise, at least in part, the aforesaid panels.

In other aspects of the present invention, embodiments are methods of making or using the aforesaid building environment control systems, panels, and buildings.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention. It is also to be understood that, unless otherwise expressly indicated, the drawings are not to scale so that the relative sizes and placements of the features depicted therein are not to be taken as absolute.

DETAILED DESCRIPTION OF PREFERRED EMBODIMENTS

In this section, some preferred embodiments of the present invention are described in detail sufficient for one skilled in the art to practice the present invention without undue experimentation. It is to be understood, however, that the fact that a limited number of preferred embodiments are described herein does not in any way limit the scope of the present invention as set forth in the claims. It is to be understood that whenever a range of values is described herein or in the claims that the range includes the end points and every point therebetween as if each and every such point had been expressly described. Unless otherwise stated, the word "about" as used herein and in the claims is to be construed as meaning the normal measuring and/or fabrication limitations related to the value which the word "about" modifies. Unless expressly stated otherwise, the term "embodiment" is used herein to mean an embodiment of the present invention.

Building Environmental Control Systems

Figure 1:
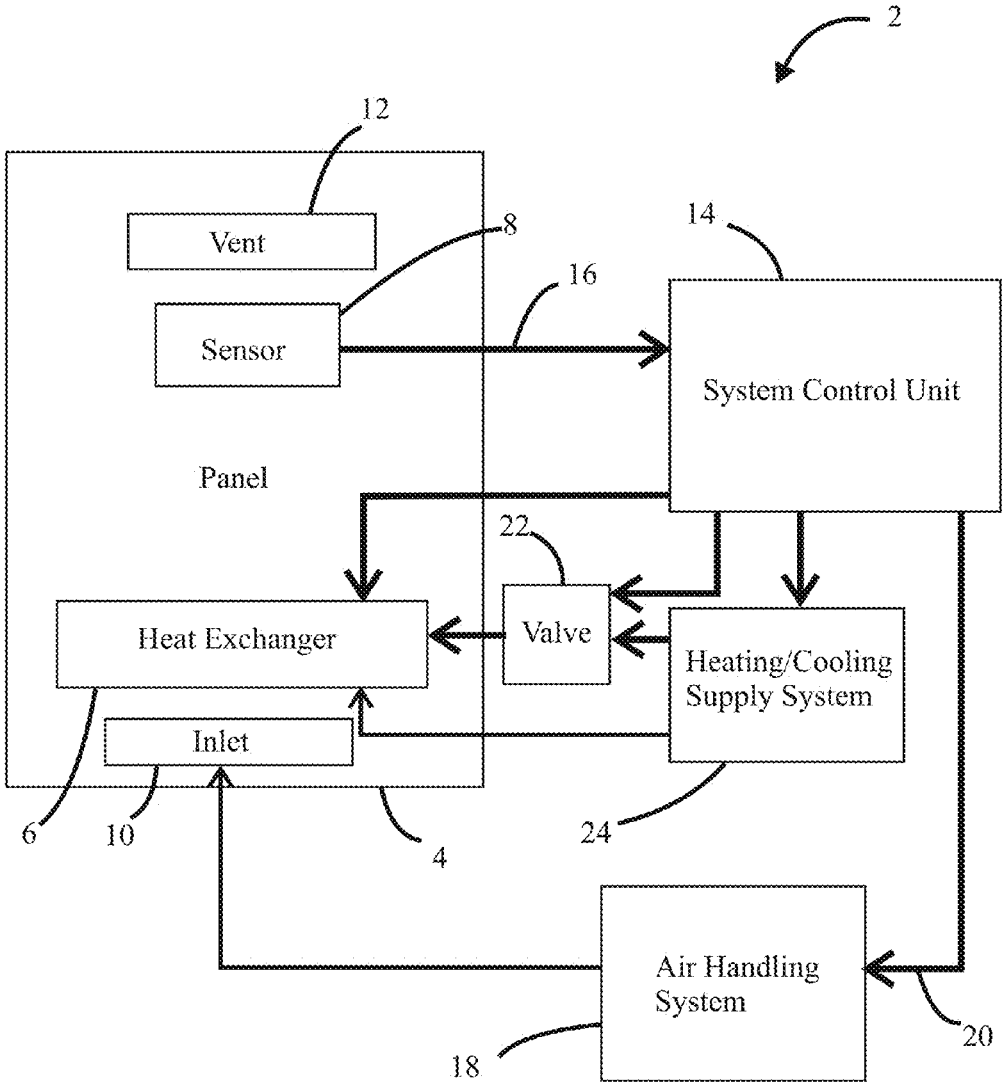
FIG. 1 is a schematic drawing of a building environmental control system embodiment.

FIG. 1 is a schematic diagram of an embodiment of a building environmental control system showing a building environmental control system 2. The building environmental control system 2 includes an inventive panel 4 such as is described herein below. The panel 4 has a hollow inner space (not depicted) and includes a heat exchanger 6 and a temperature sensor 8 located in the inner space, an air inlet 10, and a vent 12. The temperature sensor 8 may be any type of device that is capable of producing a mechanical, pneumatic, electromechanical, electromagnetic signal that is indicative of its local ambient temperature. The temperature sensor 8 is in communication with the system control unit 14 via a communication medium 16, which may be any form of wired or wireless communication medium. The system control unit 14 may be a specialized controller, a computer, or any other type of mechanical, electromechanical, or electronic device which is adapted to receive a signal from the temperature sensor 8 and, in response to the reception of that signal, cause the heat exchanger 6 to be operatively controlled, and, optionally, to cause air handling system 18 to be operatively controlled.

The system control unit 14 is adapted to operatively control the thermal output and/or thermal adsorption of the heat exchanger 6. The heat exchanger 6 may be any type of heat exchanger, e.g. hydronic (using water or any type of heat transfer fluid), resistive heater, magnetic, etc. or combination thereof, that is adapted to exchange heat with a flowing air stream. Air flow is supplied into the hollow space of the panel 4 from the air handling system 18 through air stream inlet 10. The air flow passes over and/or through the heat exchanger 6 and out of the panel 4 through an air stream exit vent 12. The system control unit 14 optionally may control the flow rate of the air delivered from the air handling system 18 to the panel 4 via a communication medium 20, which may be any form of wired or wireless communication medium and which communicates to a regulating mechanism (not depicted) of the air handling system 18.

It is to be understood that although FIG. 1 depicts the temperature sensor 8 as being located between the heat exchanger 6 and the vent 12 such that the air flow that enters inlet 10 will be conditioned by the heat exchanger 6 before it passes the temperature sensor 8 on its way to the vent 12, this depiction is not meant to confine the location of the temperature sensor 8 to such a relative location within the inner space of a panel 4 or to limit the number of temperature sensors contained by a panel. What is important is that a panel's temperature sensor or temperature sensors communicate to the system control unit signals which are indicative of the panel's thermal state which may be used to operatively control the heat exchanger to purposefully affect the mean radiant temperature experienced by an occupant of the room adjacent to the panel when that occupant is in static or variable proximity to the panel.

The system control unit 14 may directly operatively control the heat exchanger 6. Alternatively, the system control unit 14 may exert such control indirectly by controlling one or more intermediate control devices, e.g. valve 22, or by controlling a heating/cooling supply system 24 which supplies the electricity and/or fluid which the heat exchanger 6 utilizes to produce its heating and/or cooling effect. The heating/cooling system 24 may communicate directly with the heat exchanger 6 or indirectly through one or more intermediate control devices, e.g. valve 22. Although the valve 22 is depicted in FIG. 1 as a single unit being located outside of the panel 4, it is to be understood that the valve 22 may comprise a plurality of units and that the valve 22 may be located in whole or in part within or without of the panel 4 and/or be in whole or in part attached to the panel 4.

Panels

The panels of the present invention are assembled, in whole or in part, prior to their inclusion as part of a building. Preferably, the assembly is done within a facility which is off sight from the building construction site, although full or partial assembly may be done in a facility that is provided for that purpose on the building construction site. The panels of the present invention may be attached to the exterior or interior of a building and/or to one another using any conventional means. The panels of the present invention are usable with conventional panel support and construction systems. The panels of the present invention may be adapted for use with or may incorporate any conventional sealing systems.

FIGS. 2-5 show various schematic views of an embodiment of a panel 30 in juxtaposition with lower and upper fragmentary elements 32, 34 of building into which the panel 30 has been incorporated as part of its sheathing. In these drawings, the lower fragmentary element 32 comprises a portion of lower deck 36 and a portion of a raised floor 38 which is supported upon stanchions 40. The upper fragmentary element 34 comprises a portion of an I-beam 42, which is a portion of the building frame, and a portion of an upper deck 44, which is supported by I-beam 42. Note that all of these drawings include strong shadowing from an imaginary light source situated above and to the left of depicted elements.

Figure 2:
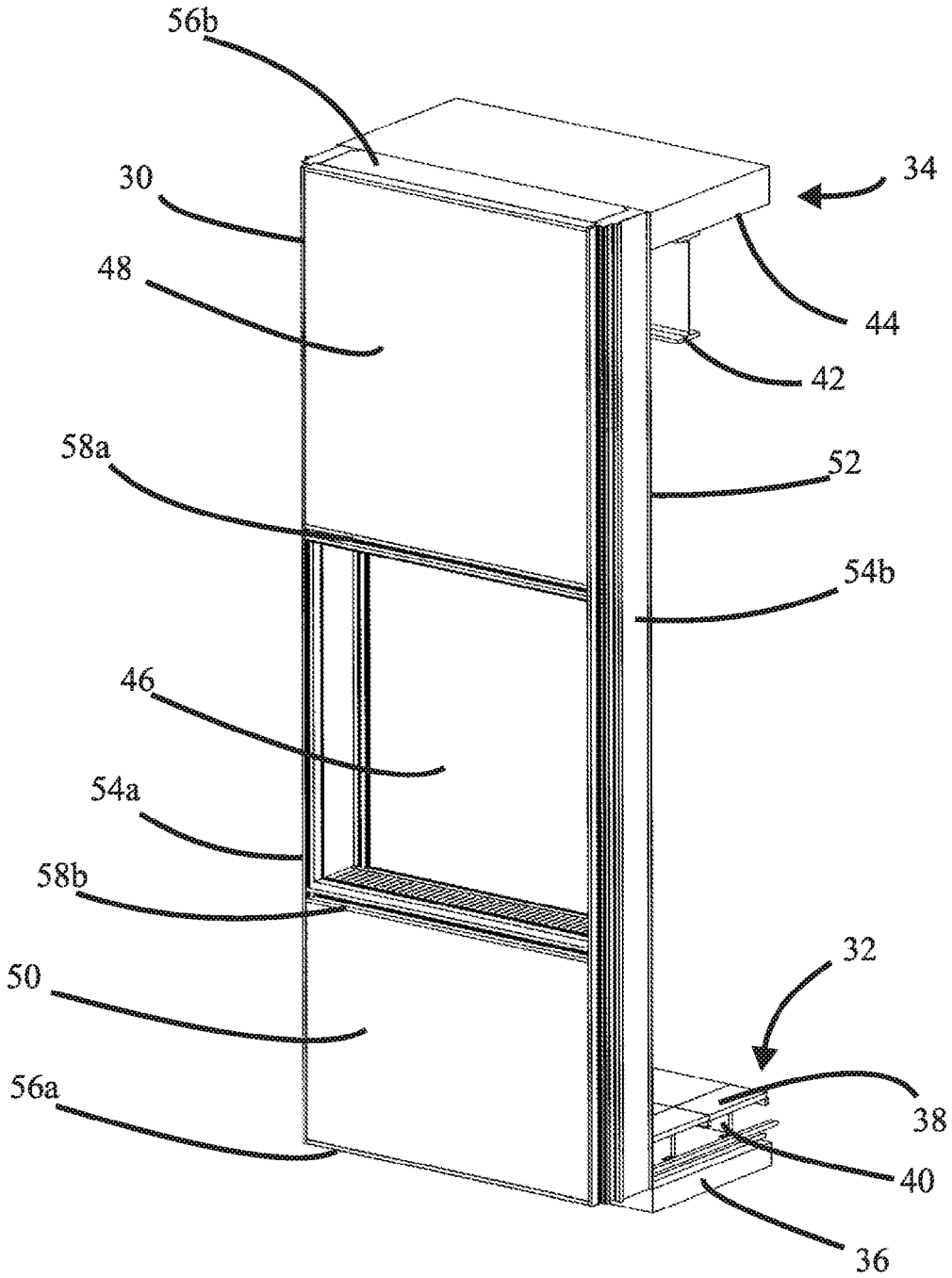
FIG. 2 is a schematic perspective view of the outer side of a panel embodiment in juxtaposition with fragmentary elements of a building to which it is attached.
Figure 3:
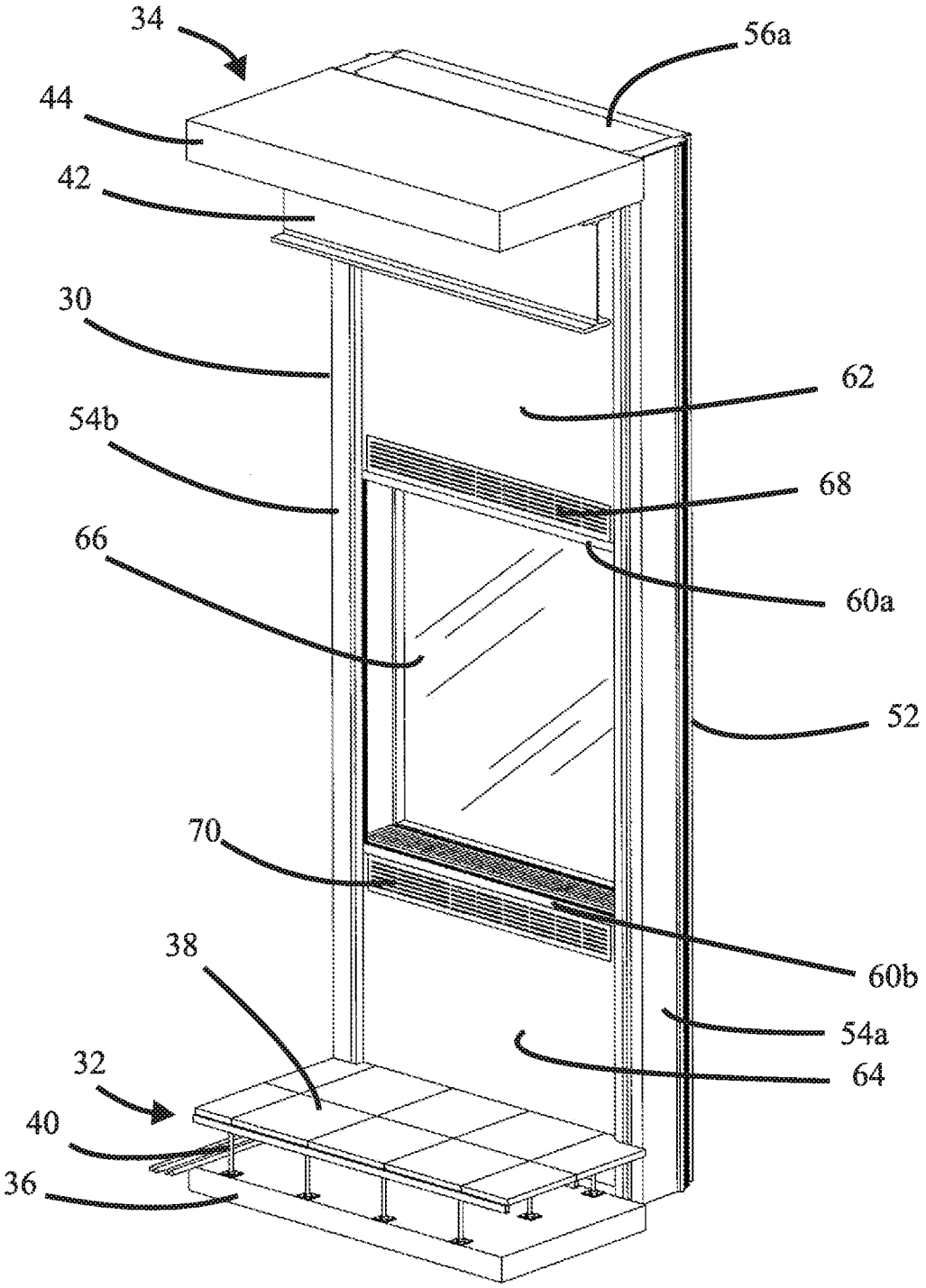
FIG. 3 is a schematic perspective view of the inner side of the panel of FIG. 3.

FIG. 2 partially depicts the outer, i.e. weather, side of the panel 30. The panel 30 has an outer window 46 interposed between an upper outer spandrel section 48 and a lower outer spandrel section 50, all contained by a frame 52. The frame 52 comprises two vertical members 54*a*, 54*b*, two horizontal end members 56*a*, 56*b*, two outer horizontal supporting members 58*a*, 58*b*, and two inner horizontal supporting members 60*a*, 60*b* (see FIG. 3). The two outer horizontal supporting members 58*a*, 58*b* separate the upper and lower outer spandrel sections 48, 50, respectively, from the outer window 46 and help support, respectively, the outer window 46 and the upper spandrel section 50. Referring to FIG. 3, the two inner horizontal supporting members 60*a*, 60*b* separate the upper and lower inner spandrel sections 62, 64 from the inner window 66 and help support, respectively, the inner window 66 and the upper inner spandrel section 62.

FIG. 3 partially depicts the inner, i.e. interior, side of the panel 30. Note that the panel 30 is partially obscured in FIG. 3 by the fragmentary elements 32, 34 and the shadowing from these elements 32, 34. FIG. 3 shows the inner window 66 interposed between the upper inner spandrel section 62 and the lower inner spandrel section 64. The panel 30 also has a upper vent 68 and an lower vent 70 for providing fluid communication between the inner space 72 of the panel 30 and the room adjacent to panel 30.

Figure 4:
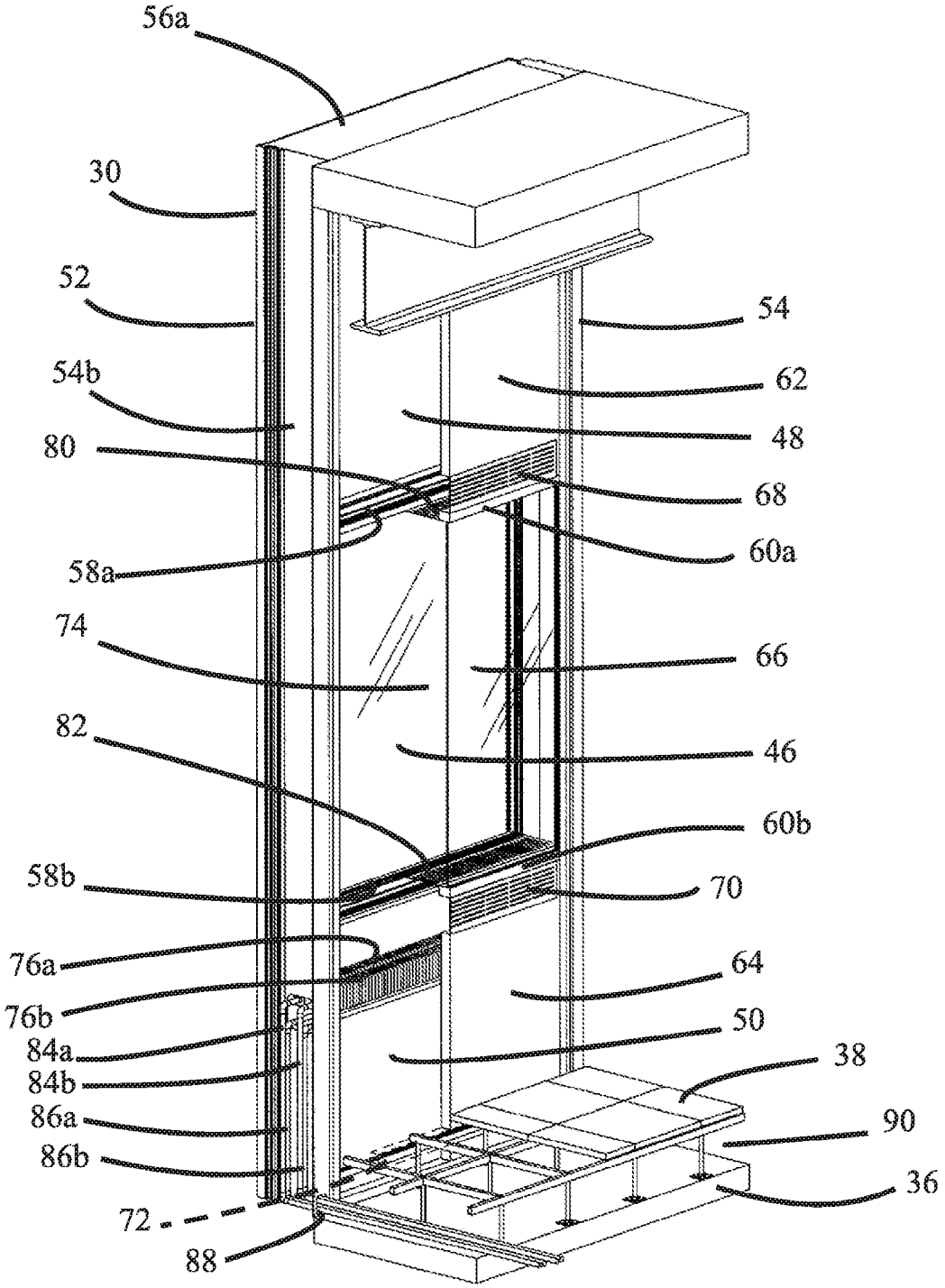
FIG. 4 is a schematic perspective view, partly in cross-section, of the panel of FIG. 3.
Figure 5:
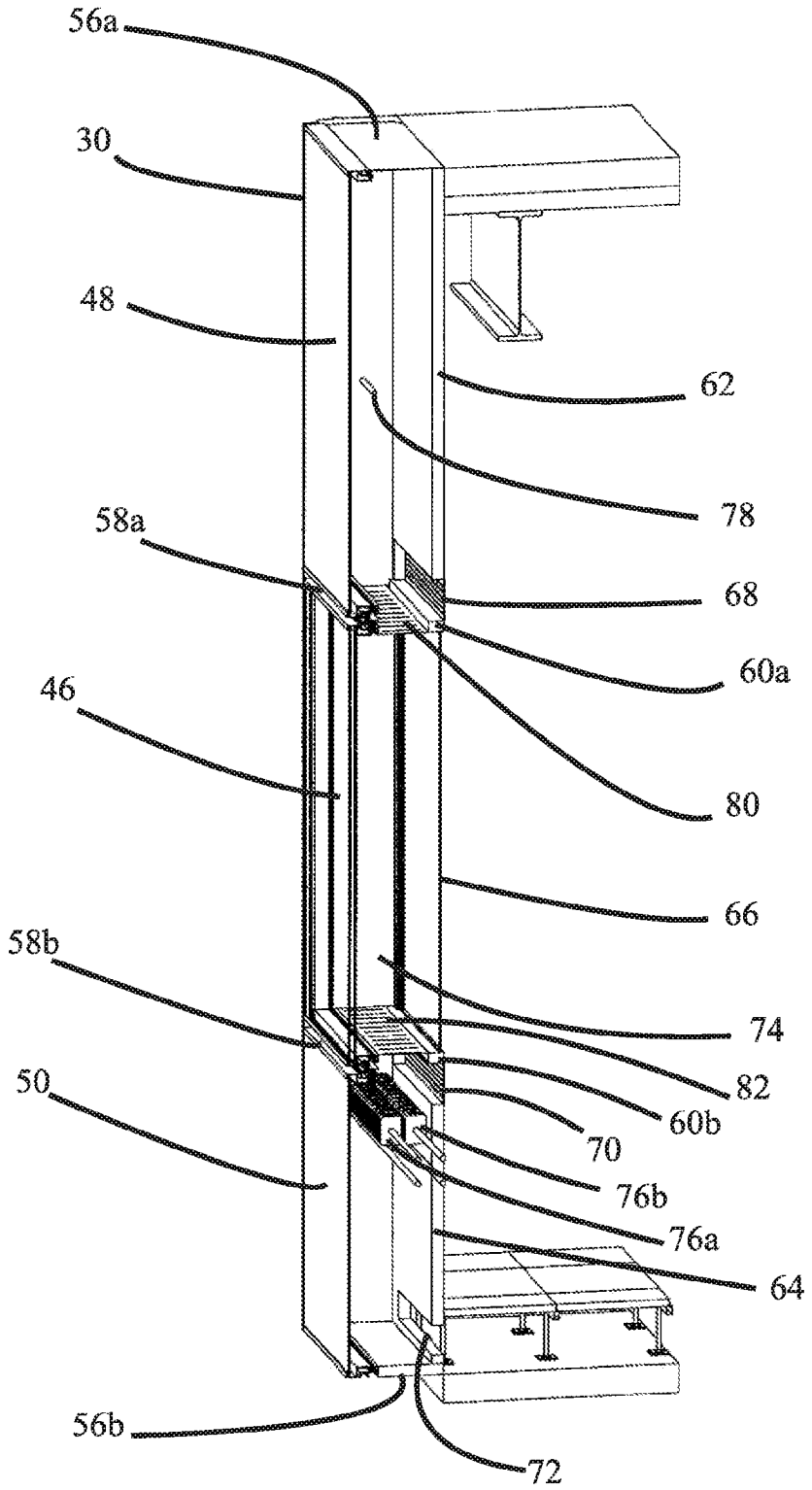
FIG. 5 is a schematic perspective view of the cross-section of the panel of FIG. 2.

FIGS. 4 and 5 show portions of the inner space 72 of the panel 30. FIG. 4 does this by providing a partial cutaway view of the inner side of the panel 30 and FIG. 5 does this by showing a cutaway perspective view taken along the vertical mid-plane of the panel 30 as seen from outside of the building. Referring now to these drawings, the following elements of the panel 30 which are visible from the outside of the panel 30 are depicted in at least one of these two drawings: the two vertical members 54*a*, 54*b*, the two horizontal members 56*a*, 56*b*, the two outer horizontal supporting members 58*a*, 58*b*, and the two inner horizontal supporting members 60*a*, 60*b* of the frame 52; the upper and lower outer spandrel sections 48, 50; the upper and lower inner spandrel sections 62, 64; the outer window 46; the inner window 66; and the upper and lower exit vents 68, 70. These figures also show that the panel 30 has an air receiving vent 72 (shown with dashed lines at the position it would have in the removed portion of the lower inner spandrel 64) and that the panel 30 has located within its inner space 74 the hydronic heat exchangers 76*a*, 76*b*, a temperature sensor 78, and the upper and lower grates 80, 82. The hydronic heat exchangers 76*a*, 76*b* have feed lines 84*a*, 84*b*, respectively, and return lines 86*a*, 86*b*, respectively. The feed lines 84*a*, 84*b*, and the return lines 86*a*, 86*b* extend through the opening 88 in the vertical member 54*b* of the frame 50. The panel 30 is adapted to receive an air stream to be supplied to its inner space 74 from the building's air handling system via the subfloor space 90 between the lower deck 36 and the raised floor 38 which comprises an air conveying duct of the air handling system.

Figure 6:
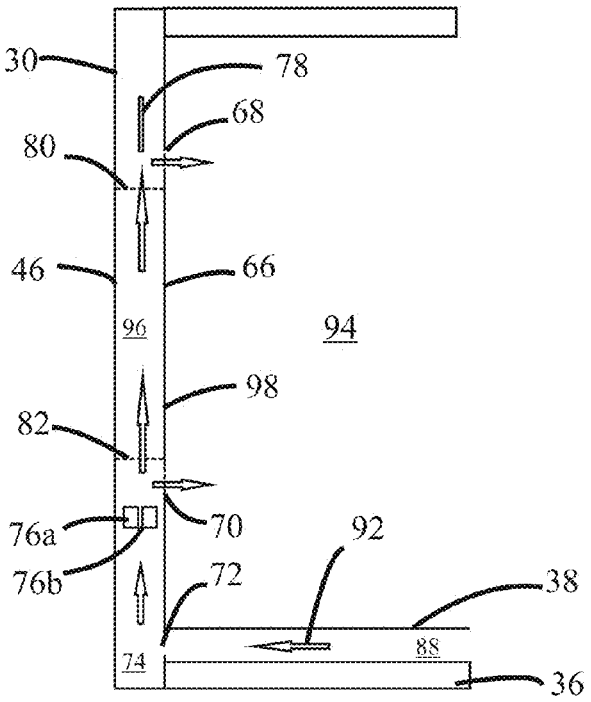
FIG. 6 is a schematic drawing of a side cross-sectional view of a panel embodiment being supplied an air stream from the building's subfloor air handling duct.

FIG. 6 schematically illustrates the thermal conditioning of an air stream by an embodiment. The supplied air stream 92 (indicated by wide arrows) conveyed by the subfloor space 88 enters the panel 30 through the air receiving vent 72. The temperature of the hydronic heat exchangers 76*a*, 76*b* are controlled by the system control unit (not shown) in accordance with the inner space temperature indicative signals received by the system control unit from the temperature sensor 78. As the air stream 92 moves past and/or through the heat exchangers 76*a*, 76*b*, its temperature is modified by the heat exchangers 76*a*, 76*b*. The air stream 92 continues flowing upward through the inner space 74. Some of the air stream 92 exits the inner space 74 through the lower exit vent 70 into the room 94 while some of it flows through the lower grate 82, then through the space 96 between the outer and inner windows 46, 66, then through the upper grate 80, and then out of the inner space 74 into the room 94 through the upper exit vent 68.

Figure 7:
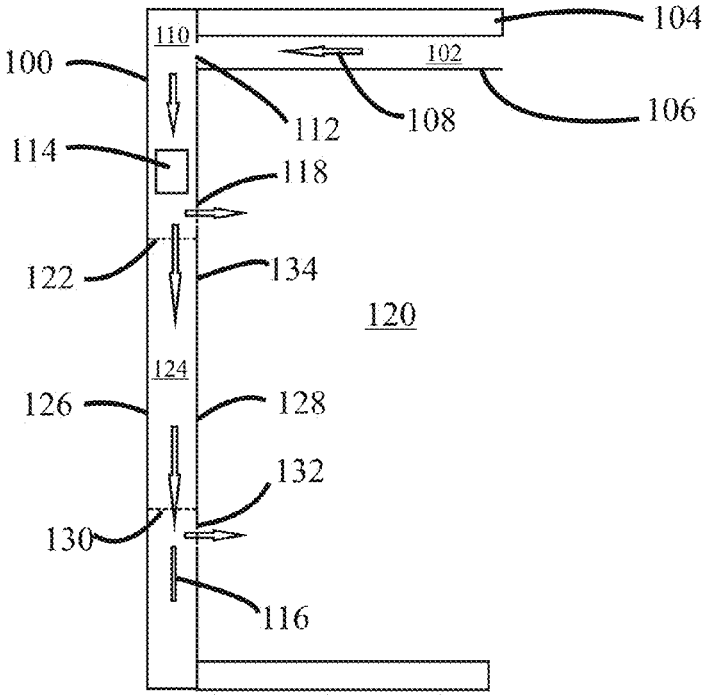
FIG. 7 is a schematic drawing of a side cross-sectional view of a panel embodiment being supplied an air stream from the building's overhead air handling duct.

FIG. 7 schematically shows another panel embodiment, the panel 100, which is adapted to receive an air stream to be supplied from the building's air handling system via a ceiling space 102 between an overhead deck 104 and a drop ceiling 106. The supplied air stream 108 (indicated by wide arrows) conveyed by the ceiling space 102 enters the inner space 110 of the panel 100 through the air receiving vent 112. The temperature of the heat exchanger, in this example single electric heat exchanger 114, is controlled by the system control unit (not shown) in accordance with the inner space temperature indicative signals received by the system control unit from the temperature sensor 116. As the air stream 102 moves past and/or through the heat exchanger 114 its temperature is modified by the heat exchanger 114. The air stream 102 continues flowing downward through the inner space 110. Some of the air stream 102 exits the inner space 110 through the upper exit vent 118 into the room 120 while some of it flows through the upper grate 122, then through the space 124 between the outer and inner windows 126, 128, then through the lower grate 130, and then out of the inner space 110 into the room 120 through the lower exit vent 132.

It is to be recognized that the temperature of face of an inventive panel adjacent to an interior room, e.g. the face 98 of the panel 30 in FIG. 6 and the face 134 of the panel 100 in FIG. 7, is controllably adjusted by the temperature of the air flow within the inner space, e.g. the inner space 74 of the panel 30 and the inner space 110 of the panel 100, so as to controllably affect the sensible radiant component of occupants of the adjacent room, e.g. the room 94 and the room 120.

Although the panel embodiments described in FIGS. 2-7 included both windows and spandrel sections, some other panel embodiments comprise windows with no spandrel sections and still other panel embodiments comprise spandrel sections with no windows. Nonetheless, these embodiments comprise an inner space, which may have a temperature sensor and a heat exchanger adapted to modify the temperature of an air stream received from an air handling system and to discharge the conditioned air stream into an adjacent room.

Figure 8:
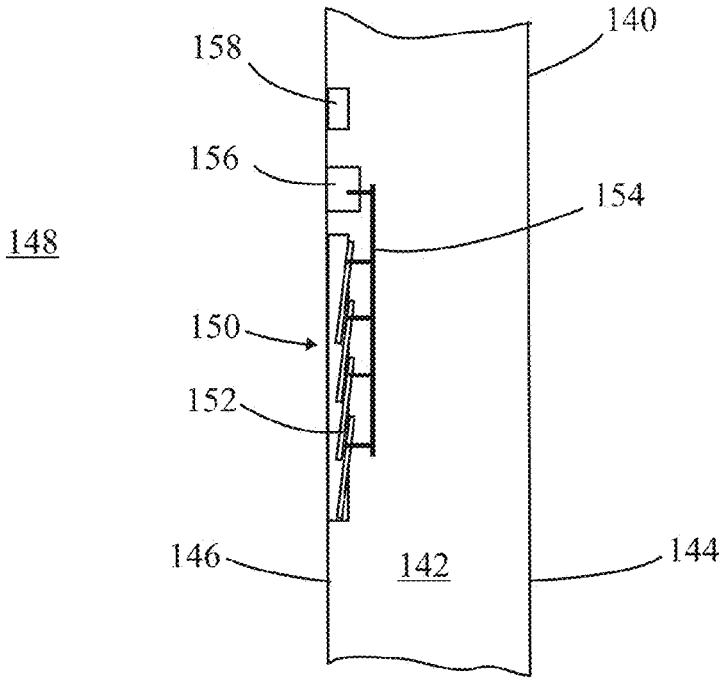
FIG. 8 is a schematic drawing of a side cross-sectional view of a panel embodiment having a vent to the environment adjacent to its outer side.

Some panel embodiments have one or more vent openings on their outside face to permit air to be exchanged between the inside space of the panel and the environment adjacent to the outside face. FIG. 8 schematically depicts one such embodiment, i.e. panel 140. The panel 140 is a windowless panel and only a portion of the mid-section of the panel 140 is shown as a side cross-sectional view. For clarity, the heating exchanger of panel 140 and the related supply and return lines are omitted from the drawing. The panel 140 has inner space 142 located between its inside face 144 and its outside face 146. The outside face 146 is adjacent to environment 148, which may the outdoors in the case where the panel 140 is part of the outside skin of a building or may be a space within the building where the panel 140 is part of an internal partition of the building. The panel 140 has located on its outside face 146 a vent 150 which provides fluid communication between the inner space 142 and the environment 148. Preferably, the vent 150 has an opening and closing mechanism, e.g. pivoting louvers 152 in conjunction with connecting device 154, which is selectably adjustable between a fully closed and a fully open position by means of a control unit, e.g. a motor 156, which may any type of electrical, pneumatic or other device operably connected to the opening and closing mechanism of vent 150. In preferred embodiments, the control unit is in operational communication with a system control unit, e.g. the system control unit 14 shown in FIG. 1, so that the system control unit can variably control the open/close state of the opening and closing mechanism, based in whole or in part upon signals received by the system control unit from one or more sensors, e.g. sensor 158. Such sensors, which may include temperature and/or humidity sensors, may be located within the inner space 142 or attached to the exterior of the panel 140, elsewhere.

It is to be understood that although the panel embodiments described above have all vents and air inlets located on either an inner or an outer face, these elements of the panels do not have to be so located. In some panel embodiments, an air inlet or vent may be located on the surface of the panel's frame. For example, a horizontal air flow may be introduced into a panel's inner space through one or more air inlets located on a vertical member of the panel's frame or vertical air flow may be introduced into a panel's inner space through one or more inlets located on a horizontal end member of a panel's frame.

Some panel embodiments include utility conduits to facilitate the installation of one or more building utilities lines, e.g. communication lines, electrical lines, plumbing lines, etc. Some panel embodiments include one or more termination ports adjacent to the utility conduits. The termination ports are adapted to receive a utility component such as an interface, outlet, junction box, connector, etc. that is to be used in conjunction with utility lines which may be installed in the utility conduits. A termination port may be located on a panel outside or inside face. Some panel embodiments include one or more preinstalled utility lines and/or one or more preinstalled utility components. In panels which have a preinstalled utility component, the utility components may be installed within the aforementioned termination ports or on a panel outside or inside face. Some embodiments include access ports, preferably with access port covers, on at least one of their outside and inside faces. The access ports provide access to the inside space of the panel and are preferably located proximal to a component, e.g. a sensor, heat exchanger, etc., or utility line that is contained within the inside space to facility the maintenance, repair, or replacement of the component.

It is to be understood that the locations of the windows, spandrel sections, heat exchangers, sensors, vents, connections, ports, and other features of the panels shown and described in relation to the drawings is not to be construed as restricting those features to those locations. Rather, the features of the panels may be positioned in any location on or within the panel that makes the feature usable for its intended purpose. It is also to be understood that the outside face and the inside face of a panel may include any number of windows and spandrel sections and that the windows and spandrel sections can be of any size. Although it is preferred that the window and/or spandrel sections of the outer face of a panel align horizontally and vertically with corresponding window and/or spandrel sections of the inside face of the panel, neither type of alignment is necessary for a panel to be within the scope of the present invention. Moreover, it is not necessary for the outside and inside faces of a panel to have corresponding window and/or spandrel sections. For example, for aesthetic effect, a panel may have one of its inner or outer faces be all window and the other of its inner or outer faces to be all spandrel section. Likewise, it is not necessary for the interior components of the panel to be masked by any spandrel section. It is also to be understood that the components of the panel's frame are chosen to accommodate the panel's inner and outer face members as well as to perform its structural role of maintaining the integrity of the panel in use. For example, a panel may have no horizontal supporting members, e.g. inner horizontal supporting member 60*a*, or may have more than two horizontal supporting members for a face. Also, although not shown in the drawings, where desired, a panel may include one or more vertical or angled members on one or both of its faces as is desired to divide and/or support the windows and/or spandrel sections on the relevant panel face.

Panel embodiments may include any conventional type, style, and construction of window. Likewise, panel embodiments may include any conventional type, style, and construction of spandrel sections. The materials of construction of the panels are to be chosen to enable the panels to fulfill their structural and environmental purposes. Preferably, the spandrel sections comprise thermal insulation components or have thermal insulating components in proximity to them.

Although the panel embodiments described thus far comprise components located within their inner spaces, some panel embodiments comprise outer and inner faces separated by an inner space and maintained in fixed relationship to one another by a frame. Such panel embodiments are referred to herein as "pass-through panels" because the air stream that is supplied to them from the building's air handling system passes through them without being thermally conditioned by a heat exchanger contained within the panel's inner space. A pass-through panel may have its vents and panel faces arranged as previously described herein.

Panel Groupings

The panels of the present invention may be grouped together in any desired combination to provide one or more portions of a building's sheath or of a building's interior partition. The inventive panels may also be grouped with conventional panels or other conventional structural elements.

Figure 9:
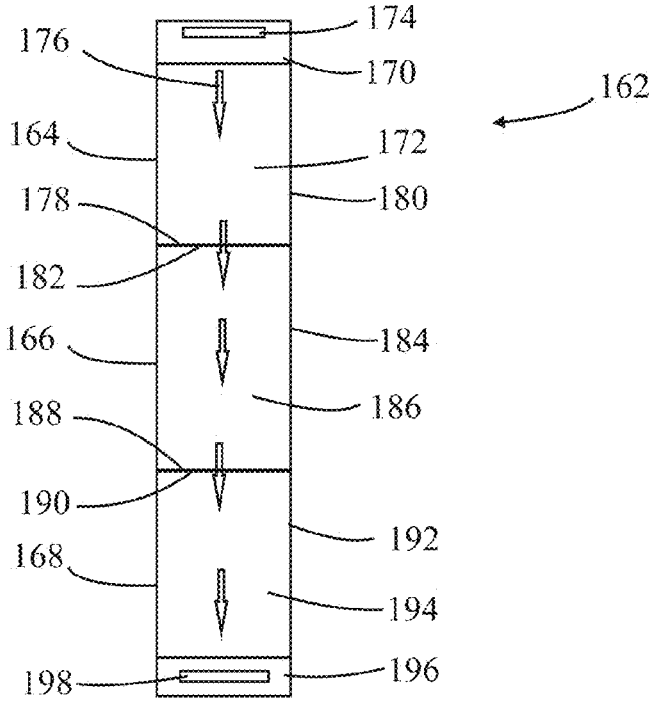
FIG. 9 is a schematic elevational view of the inside faces of three panel embodiments comprising a portion of a glass wall.

FIG. 9 shows a schematic depiction of a group 162 of three inventive panels grouped together to form a portion of a glass wall on the outside of a building viewed from inside of the building. The group 162 includes top panel 164, middle panel 166, and bottom panel 168. The top panel 164 includes an inside spandrel section 170, behind which is hidden a heat exchanger (not visible) within its inner space, and inner window 172. The spandrel section 170 has an air stream inlet 174 for receiving an air stream 176 (depicted in part by wide arrows) from the building's air handling system (not depicted). The top panel 164 has a vent (not visible) in the lower horizontal member 178 of its frame 180. The middle panel 166 has an air stream inlet (not visible) located in the upper horizontal member 182 of its frame 184 which is in fluid communication with the vent located in the lower horizontal member 178 of the top panel 164. The middle panel 166 also has an inner window 186 and a vent (not visible) located in the bottom horizontal member 188 of its frame 184. Note that the middle panel 166 is a pass-through panel. The lower panel 168 has an air stream inlet (not visible) located in the upper horizontal member 190 of its frame 192 which is in fluid communication with the vent located in the bottom horizontal member 188 of the middle panel 166. The lower panel 168 also has an inside window 194 and an inside spandrel section 196. The lower panel 168 has a heat exchanger (not visible) within its inner space which is hidden by the spandrel section 196. A vent 198 is located in the spandrel section 196. The air stream 176 enters the top panel 166 through the air stream inlet 174 and is conditioned by the heat exchanger of the top panel 166. It exits the top panel 164 through the vent located in the bottom horizontal member 178 and flows through the air stream inlet located in the upper horizontal member 182 of the middle panel 166 and flows through the inner space of the middle panel 166 to exit through the vent in the lower horizontal member 188 of the middle panel 166. The air stream 176 then flows into the lower panel 168 through the air flow inlet in the upper horizontal member 192 of the lower panel 168. The temperature of the air stream 176 is conditioned by the heat exchanger of the lower panel 168 and then flows out of the inner space of the panel 168 through the vent 198 into the room adjacent to the glass wall 162.

Buildings

Embodiments also include buildings having the inventive panels described herein as components of their sheathing and/or as components of one or more internal partitions. Building embodiments also include buildings having the inventive building environmental control systems described herein. The building embodiments may be of any shape, may be adapted for any type of use, e.g., commercial office space, residential, manufacturing, etc., and be of any desired size, e.g. a single family dwelling, a skyscraper, etc.

While only a few embodiments of the present invention have been shown and described, it will be obvious to those skilled in the art that many changes and modifications may be made thereunto without departing from the spirit and scope of the invention as described in the claims.

What is claimed is:

1. A prefabricated building panel comprising:

(a) an outer wall and an inner wall, each of the outer and inner walls having an outer and an inner surface, the respective inner surfaces of the outer and inner walls defining an open inner space therebetween, the inner space having a width of no more than about 18 inches (about 0.7 m);

(b) a frame having first and second horizontal end members each having an outside surface and first and second vertical members each having an outside surface, the frame being adapted to fix the outer and inner walls in spatial relationship to one another and having an outside surface comprising the respective outside surfaces of the first and second horizontal end members and of the first and second vertical members;

(c) an inlet adapted to receive an air stream into the inner space;

(d) an outlet adapted to permit the air stream to flow out of the inner space;

(e) a sensor located within the inner space and adapted to provide a signal indicative of the temperature of at least a portion of the inner space;

(f) a heat exchanger located within the inner space and adapted to thermally condition the air stream in response to the signal of the sensor; and (g) an outer surface comprising the respective outside surfaces of the frame and of the first and second walls;

wherein the inner space is adapted to carry the air stream in contact with the respective inner surfaces of the outer and inner walls from the inlet to the outlet prior to the air stream exiting the inner space and the panel is an independent unit and is adapted to be attached to a building's frame.

2. The prefabricated building panel of claim 1 wherein at least one of the outer wall and the inner wall comprises at least one of a window and a spandrel section.

3. The prefabricated building panel of claim 1 further comprising a grate located within the inner space.

4. The prefabricated building panel of claim 1 wherein the building panel is adapted to be attached to a building frame to form a portion of a sheathing of a building.

5. The prefabricated building panel of claim 1 wherein the building panel is adapted to form a portion of an interior partition of a building.

6. The prefabricated building panel of claim 1 further including a controllably closable vent located in the outer wall, the controllably closable vent, when at least partially open, being in fluid communication with the inner space.

7. A building environmental control system comprising:

(a) a prefabricated building panel having (i) an outer wall and an inner wall, each of the outer and inner walls having an outer and an inner surface, the respective inner surfaces of the outer and inner walls defining an open inner space therebetween, the inner space having a width of no more than about 18 inches (about 0.7 m);

(ii) a frame having first and second horizontal end members each having an outside surface and first and second vertical members each having an outside surface, the frame being adapted to fix the outer and inner walls in spatial relationship to one another and having an outside surface comprising the respective outside surfaces of the first and second horizontal end members and of the first and second vertical members;

(iii) an inlet adapted to receive an air stream into the inner space;

(iv) an outlet adapted to permit the air stream to flow out of the inner space;

(v) a sensor located within the inner space and adapted to provide a signal indicative of the temperature of at least a portion of the inner space;

(vi) a heat exchanger located within the inner space and adapted to thermally condition the air stream in response to the signal of the sensor; and (vii) an outer surface comprising the respective outside surfaces of the frame and of the first and second walls;

wherein the inner space is adapted to carry the air stream in contact with the respective inner surfaces of the outer and inner walls from the inlet to the outlet prior to the air stream exiting the inner space and the panel is an independent unit and is adapted to be attached to a building's frame; and (b) a system control unit;

wherein the system control unit is adapted to receive the signal from the sensor and, in response to the signal, to adjustably control the thermal state of the heat exchanger.

8. The building environmental control system of claim 7 further comprising an air handling system adapted to provide the air stream to the inlet, wherein the system control unit is adapted to adjustably control the air handling system to adjustably provide the air stream to the inlet.

9. The building environmental system of claim 7 further comprising a supply system, the supply system being adapted to provide a utility to the heat exchanger, wherein the system control unit is adapted to adjustably control the supply system to adjustably provide the utility to the heat exchanger.

10. The building environmental control system of claim 7 wherein at least one of the outer wall and the inner wall comprises at least one of a window and a spandrel section.

11. The building environmental control system of claim 7 wherein the prefabricated building panel further comprises a grate located within the inner space.

12. The building environmental control system of claim 7 wherein the prefabricated building panel is adapted to be attached to a building frame to form a portion of a sheathing of a building.

13. The building environmental control system of claim 7 wherein the prefabricated building panel is adapted to form a portion of an interior partition of a building.

14. A building comprising a prefabricated building panel having:

(a) an outer wall and an inner wall, each of the outer and inner walls having an outer and an inner surface, the respective inner surfaces of the outer and inner walls defining an open inner space therebetween, the inner space having a width of no more than about 18 inches (about 0.7 m);

(b) a frame having first and second horizontal end members each having an outside surface and first and second vertical members each having an outside surface, the frame being adapted to fix the outer and inner walls in spatial relationship to one another and having an outside surface comprising the respective outside surfaces of the first and second horizontal end members and of the first and second vertical members;

(c) an inlet adapted to receive an air stream into the inner space;

(d) an outlet adapted to permit the air stream to flow out of the inner space;

(e) a sensor located within the inner space and adapted to provide a signal indicative of the temperature of at least a portion of the inner space;

(f) a heat exchanger located within the inner space and adapted to thermally condition the air stream in response to the signal of the sensor; and (g) an outer surface comprising the respective outside surfaces of the frame and of the first and second walls;

wherein the inner space is adapted to carry the air stream in contact with the respective inner surfaces of the outer and inner walls from the inlet to the outlet prior to the air stream exiting the inner space and the panel is an independent unit and is adapted to be attached to a building's frame.

15. The building of claim 14 wherein at least one of the outer wall and the inner wall comprises at least one of a window and a spandrel section.

16. The building of claim 14 wherein the building has a frame and the prefabricated building panel is adapted to be attached to the building frame to form a portion of a sheathing of the building.

17. The building of claim 14 wherein the prefabricated building panel is adapted to form a portion of an interior partition of the building.

18. The building of claim 14 further comprising an environmental system control unit wherein the environmental system control unit is adapted to receive the signal from the sensor and, in response to the signal, to adjustably control the thermal state of the heat exchanger.

19. The building of claim 18 further comprising an air handling system adapted to provide the air stream to the inlet, wherein the system control unit is adapted to adjustably control the air handling system to adjustably provide the air stream to the inlet.

20. The building of claim 18 further comprising a supply system, the supply system being adapted to provide a utility to the heat exchanger, wherein the system control unit is adapted to adjustably control the supply system to adjustably provide the utility to the heat exchanger.

* * * * *